United States Patent [19]

Mason et al.

[11] Patent Number: 4,805,256

[45] Date of Patent: Feb. 21, 1989

[54] SCRUBBER SQUEEGEE PIVOTED CONCENTRIC WITH BRUSH DRIVE

[75] Inventors: Richard A. Mason, Buffalo; Philip E. Koenigs, New Hope, both of Minn.

[73] Assignee: Tennant Company, Minneapolis, Minn.

[21] Appl. No.: 104,281

[22] Filed: Oct. 2, 1987

[51] Int. Cl.[4] ..... A47L 7/00

[52] U.S. Cl. ..... 15/320; 15/355; 15/385

[58] Field of Search ..... 15/49 R, 50 R, 98, 320, 15/340, 355, 359, 385

[56] References Cited

U.S. PATENT DOCUMENTS

| | | | |
|---|---|---|---|
| 3,436,788 | 4/1969 | Tamny | 15/340 |
| 3,460,184 | 4/1969 | Dyer | 15/385 |
| 3,833,961 | 9/1974 | Fortman et al. | 15/340 |
| 3,886,623 | 6/1975 | Landesman et al. | 15/340 |
| 4,000,538 | 1/1977 | Tissier | 15/320 |
| 4,037,289 | 7/1977 | Dojan | 15/320 |
| 4,041,567 | 8/1977 | Burgoon | 15/320 |
| 4,339,840 | 7/1982 | Monson | 15/320 |
| 4,485,519 | 12/1984 | Collier | 15/359 |
| 4,701,976 | 10/1987 | Palmer et al. | 15/385 |
| 4,715,087 | 12/1987 | Todd et al. | 15/385 |

*Primary Examiner*—Harvey C. Hornsby
*Assistant Examiner*—Corinne M. Reinckens
*Attorney, Agent, or Firm*—Kinzer, Plyer, Dorn, McEachran & Jambor

[57] ABSTRACT

This invention is concerned with a machine in the nature of a scrubber for removing dirt, grime, etc. from a surface to be cleaned and includes a mobile machine with a scrub brush mounted for rotation about a generally vertical axis with a housing therefor which is pivotally mounted and concentric with the scrub brush drive. The brush, brush drive, brush housing and squeegees which are mounted on the brush housing, also make up a brush head assembly that is raised and lowered as a unit.

10 Claims, 3 Drawing Sheets

Fig. 1.
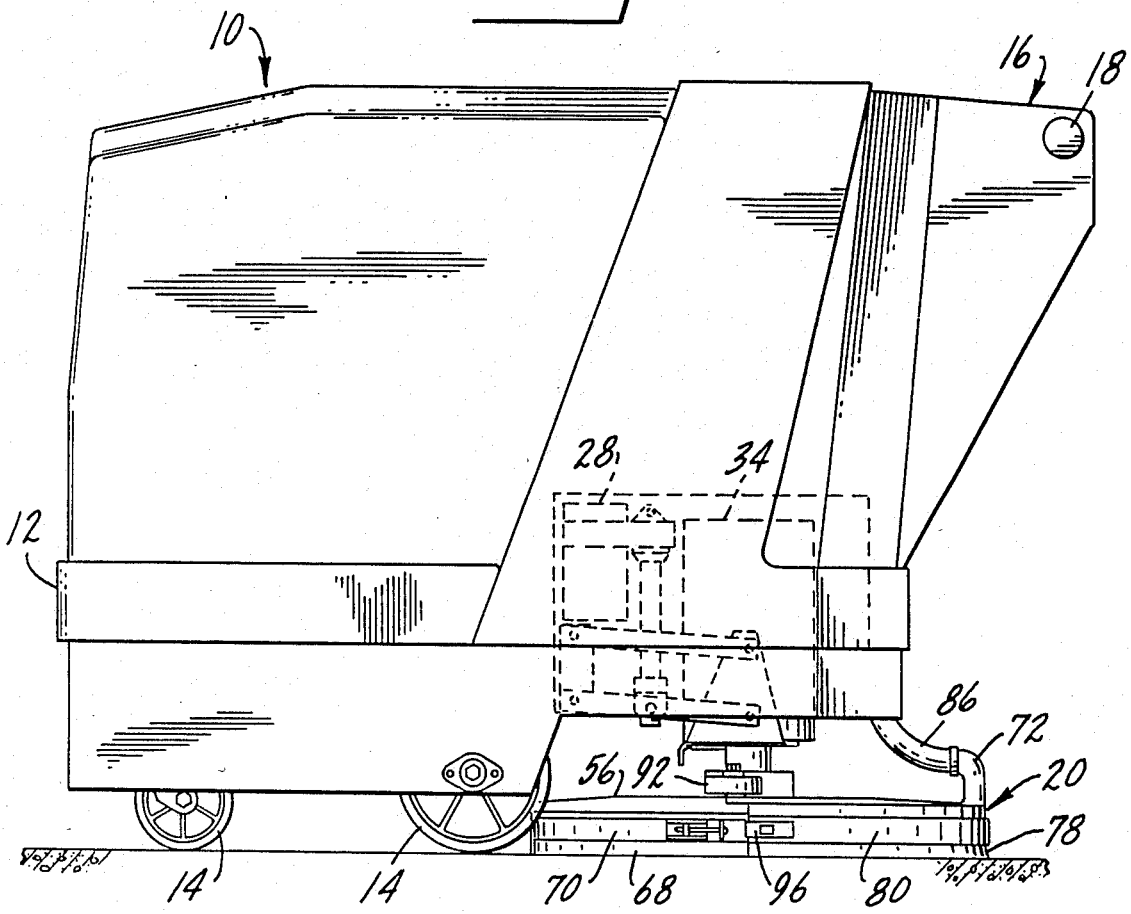
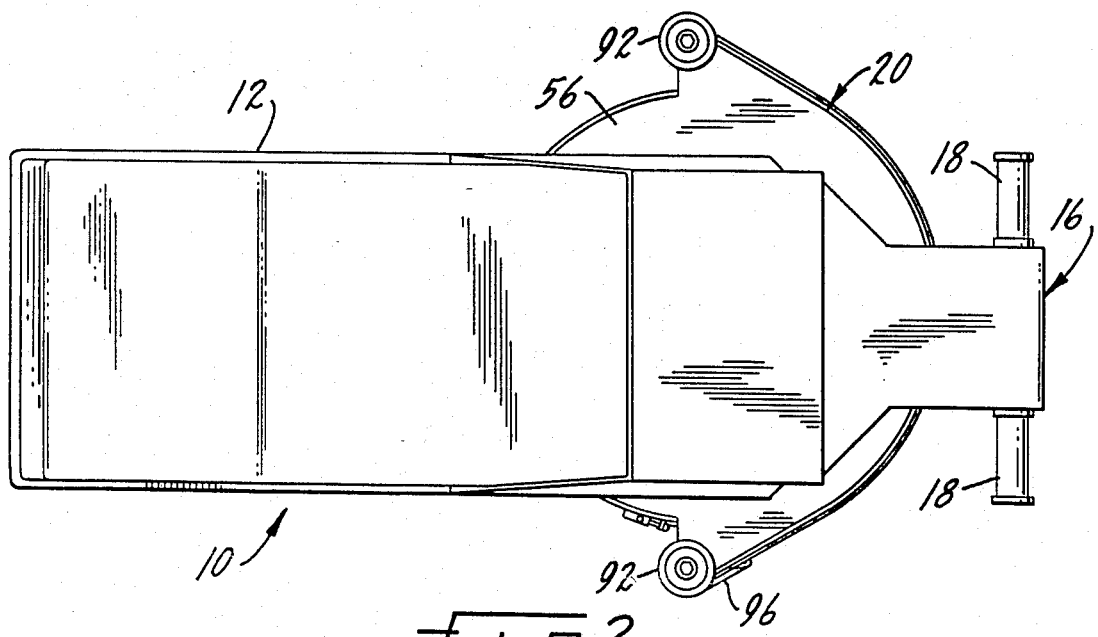
Fig. 2.

72
80
82
78
76
74
70
68
84
54
52
47
48
34
60
62
38
36
26
50
64
42
44
45
46
40
100
58
30
31
32
56
22
24
66

SCRUBBER SQUEEGEE PIVOTED CONCENTRIC WITH BRUSH DRIVE

SUMMARY OF THE INVENTION

This invention is concerned with a scrubbing machine which is a mobile unit that is either a walk-behind or a riding-type scrubber.

A primary object of the invention is a scrub head assembly constructed and arranged to rotate a disk brush about a generally vertical axis, and with an arrangement so that it can be raised and lowered.

Another object is a brush housing for a unit of the above type having squeegees attached to it, which eliminates the necessity for linkages for attaching squeegees to the scrubber.

Another object is a brush housing of the above type which is free to rotate for at least a part of one revolution about its center, which is coaxial with the brush motor shaft, and which also floats up and down relative to the brush.

Another object is a scrubber of the above type where the scrub head assembly is raised and lowered by parallel links, with the brush drive and the brush housing having a floating connection so that the housing engages the floor first and thereafter floats while the brush works and the brush and brush drive are raised first followed by the housing when they are raised for transport.

Another object is a scrub head assembly of the above type which is substantially lower in cost than prior units and eliminates a number of parts.

Another object is a scrub head assembly of the above type where the brush housing goes all the way around the brush and a squeegee lip extends throughout the full 360° so that it serves as a skirt to prevent water from being flung out when scrubbing.

Another object is a scrub head assembly of the above type having a suction squeegee attached to it, wherein the drag of the suction squeegee on the surface being cleaned exerts a force on the housing, causing it to swivel when the machine makes a turn, thereby keeping the suction squeegee tracking behind the brush at all times, so that water is not spilled out from the ends of the suction squeegee during turns.

Another object is a combination brush housing and squeegee for a scrub head assembly of the above type which greatly simplifies the overall assembly.

Another object is a rotatable and floating mounting between a brush housing and a brush drive assembly so that the rear squeegee, which is attached to the brush housing, causes the portion of the brush housing carrying it to automatically trail the brush during operation, thereby preventing water spillage around the ends of the squeegee during turns.

Another object is a scrub head assembly of the above type which has a rotating brush housing, i.e. a housing that is free to rotate for at least a part of one revolution.

Another object is a scrub head assembly of the above type which prevents water spillage out of the brush housing in a turn.

Another object is a scrub head assembly for a dual purpose machine, i.e. one that is adapted to operate in a scrubbing mode and also a burnishing mode, with a 360° skirt that prevents water from being flung out when in the scrubbing mode and assists in dust control when in the burnishing mode.

Another object is a scrub head assembly, comprising a brush, a brush drive, and a brush housing with attached squeegees, that is raised and lowered as a unit.

Another object is an assembly generally of the above type which does not have or require linkages for attaching the squeegee to the scrubber.

Another object is an assembly generally of the above type which has a rotating brush housing.

Other objects will appear from time to time in the ensuing specification and drawings.

BRIEF DESCRIPTION OF THE DRAWINGS

FIG. 1 is a side view of the machine.

FIG. 2 is a top view of FIG. 1.

BRIEF DESCRIPTION OF THE PREFERRED EMBODIMENT

In FIG. 1 a scrubber or scrubbing machine is indicated generally at 10 and may include a housing or frame indicated generally at 12 on wheels or a mobile support 14 of any suitable type with a control station 16 with handlebars 18 on the rear thereof. As shown, the machine is intended to move generally from right to left although of course it can back up. A brush and brush housing assembly is indicated generally at 20 and, in the particular form shown, is behind the wheels although it might be otherwise.

Figure 3:
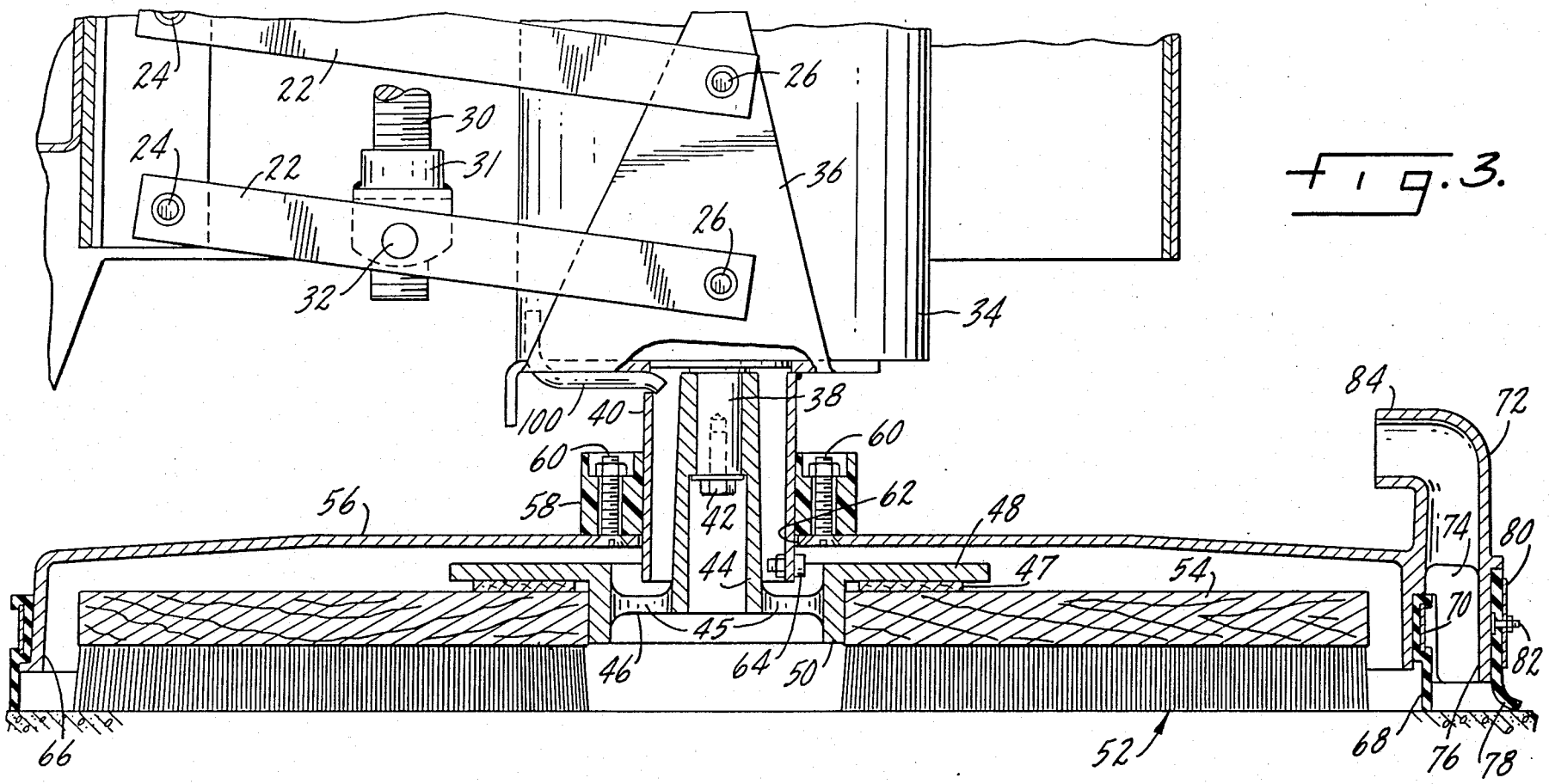
FIG. 3 is an enlargement of a portion of FIG. 1, i.e. the scrub head, partly in vertical section.

As shown in more detail in FIG. 3, a scrub head assembly is comprised of a brush 52, 54 and brush hub 44, a brush housing 56 with attached squeegees 68, 78, and a brush drive assembly, which is comprised of a drive motor 34 and motor mounting bracket 36. The scrub head assembly is mounted by parallelogram type links 22 suitably pivoted to the frame of the machine as at 24 at one end and to the motor mount bracket 36 at the other end as at 26. A suitable electric actuator, indicated generally at 28 in FIG. 1 rotates a lead screw 30 which is connected to the parallelogram as at 32 by means of a traveling nut 31 so as to raise or lower the scrub head assembly. Control of an actuator in an application such as this is described in detail in co-pending application no. 78,204 filed July 27, 1987 and assigned to the assignee of this patent. It is incorporated by reference here.

A drive motor 34 is suitably mounted in or on bracket 36 so that the drive shaft thereof as at 38, which is disposed downwardly, is adapted to rotate about a generally vertical axis. The mounting bracket 36 is connected to the parallelogram linkages 22 by the pivots 26. A suitable circular sleeve 40 of an appropriate size and type depends from the mounting bracket 36 and surrounds the drive shaft of the motor. The drive shaft is suitably connected, as at 42 to upstanding sleeve or hub 44 which in turn is connected to or is a part of a center hub 46 of a brush mounting hub which has an outstanding flange 48 and central hub 50. The buffer or scrub brush, indicated generally at 52 may be assumed to have a buffing pad or bristles connected to a backing 54 in any suitable manner. While the backing has been indicated as being made of wood, it should be understood that this is merely representative. The backing in turn is suitably connected to the center hub or mounting 46 by a Velcro type attachment 47 or other suitable means.

A brush housing 56 is mounted around the center sleeve 40 with an upstanding bushing 58 thereon suitably connected by bolts 60 or the like. The housing 56 may have an oversized hole 62 in the center thereof with the inside of the bushing 58 closely fitting around the outside of sleeve 40 with the sleeve 40 being long enough so that the bushing 58 may slide up and down on it. The lower end of sleeve 40 may have one or more stops 64, each of which may be in the form of a bolt and nut arrangement, but it might be otherwise. Three such stops are preferred, on the order of 120° apart, so that when the electric actuator, acting through the parallelogram linkage, raises the brush and the brush drive, including sleeve 40, at a point the stops 64 will hit the bottom side of the brush housing 56 and thereafter will raise it to what may be considered a traveling position.

The brush housing has a generally cylindrical down turned skirt 66 peripherally surrounding the brush or buffing pad with a 360° squeegee 68 connected thereto by a releasable retaining band 70. The squeegee may be of a rubberlike or neoprene material or any substitute therefor and should be replaced from time to time when it is worn. What may be considered the rear of the brush housing has a riser 72 integrally formed thereon which opens to a recovery channel 74 defined between the 360° squeegee 68 and an approximately 180° depending wall 76 on the brush housing which has a corresponding squeegee 78 suitably mounted thereon in a removable fashion by a band 80 and attachments 82. The recovery channel 74 thus extends approximately 180° around the outside of the brush housing and a suitable connection 84 is provided for a flexible tube 86, shown in FIG. 1, which may be connected to a source of vacuum, not shown, to pick up spent or dirty solution from a floor being worked upon.

Figure 4:
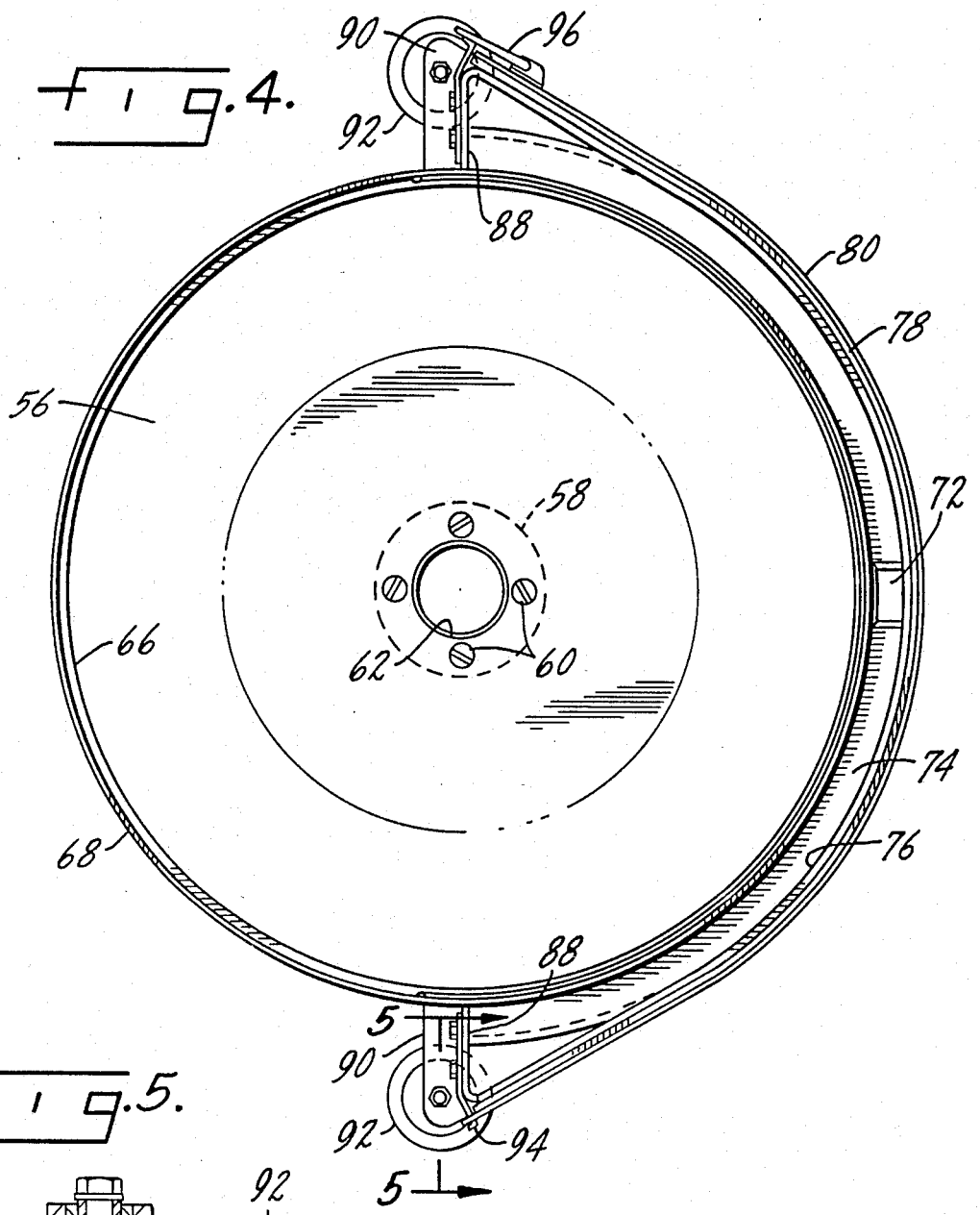
FIG. 4 is a bottom view of the scrub head of FIG. 1, on an enlarged scale.
Figure 5:
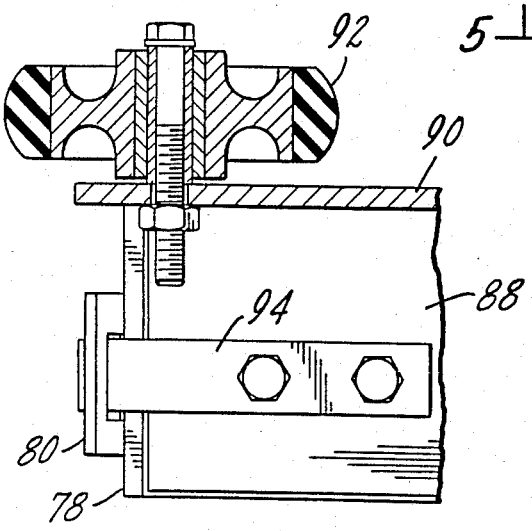
FIG. 5 is a section along line 5—5 of FIG. 4 on an enlarged scale.

It will be noted in FIG. 4 that the recovery channel ends in flat walls 88 approximately 180° apart which carry mountings 90 for vertically mounted freely rotatable guard wheels 92, shown in FIG. 5 which, on either side of the brush housing, will engage and fend off objects to protect the rear squeegee. The strap 80 for the outside squeegee may be connected to a bracket 94 at one end and suitably tensioned, as at 96, at the other end.

In FIG. 3 a suitable tubular connection 100 is shown for supplying cleaning solution to the inside of the mounting sleeve 40 and, subsequently, to the floor by way of a circle of holes 45 in brush hub 46.

The use, operation and function of the invention are as follows:

The entire scrub head assembly is tied to the frame of the machine by parallelogram links, through which an electric actuator raises and lowers the entire scrub head assembly. It is raised for transport and lowered for work. There is an absence of linkages for attaching the squeegees to the scrubber and the brush housing is free to rotate about its center for at least a part of one revolution, limited by the constraint of flexible suction tube 86. It is also free to move up and down on sleeve 40 in a coaxial reciprocating manner relative to the motor shaft. Thus, the brush housing is free to rotate about the sleeve 40 and the drag of squeegee 78 on the floor as the machine moves forward will cause the brush housing to automatically orient itself with the 180° squeegee 78 to the rear. It will follow well in a turn and will do a good job of preventing water spillage out of the brush housing in a turn. Prior art designs tend to spill water out of the ends of the rear squeegee, but this one does not.

The inside or front squeegee lip 68 goes all the way around, 360°, so that it will serve as a skirt to prevent water or cleaning solution from being flung out during scrubbing and will assist in dust control when burnishing. The invention is not limited to a scrubber but may be used as well where a buffing pad has been substituted for the scrub brush shown.

The invention also may be applied to units other than a single spindle scrubber or buffing machine, which is to say the machine might have more than one brush or burnishing pad. In that case the vertical pivot for the brush housing would be in the center of the brush housing, but not necessarily concentric with a brush drive motor.

While the preferred form and several variations have been shown, it should be understood that suitable additional modifications, changes, substitutions and alterations may be made without departing from the invention's fundamental theme.

We claim:

1. In a machine for removing soilage from a surface, a mobile frame and means for propelling it, a tool drive comprising a motor and a motor mount therefor attached to the frame, a disk surface cleaning tool connected to the tool drive disposed for rotation about a generally upright axis, means for raising and lowering the tool between a raised inoperative position for traveling and a lowered operative position for working, a tool housing around the tool which approaches the surface in the working position of the tool and is raised above the surface in the raised traveling position of the tool, a rotatable mounting for the tool housing concentric about the axis of the tool so that the tool housing may be rotated for at least a portion of a revolution about the upright axis independent of the tool and tool drive and the tool housing is free to circumferentially orient itself independently of movement of the mobile frame, an arcuate vacuum chamber disposed around on the order of 180° of the periphery of the tool housing and defining a pick up for dirty scrubbing solution, and friction means engaging the surface causing the tool housing to automatically orient itself in response to movement of the mobile frame because of the force applied to it by the friction means so that the vacuum chamber is always in a trailing position.

2. The structure of claim 1 further characterized in that the friction means at least in part includes a squeegee disposed around on the order of 180° of the periphery of the tool housing which causes the housing to circumferentially orient itself automatically in response to movement of the frame because of the force applied to the housing by frictional engagement of the squeegee with the surface being worked upon.

3. The structure of claim 2 further characterized by and including a continuous peripheral skirt on the tool housing that at least in part is defined by a rubberlike single bladed squeegee mounted on the 360° periphery of the tool housing and extending downwardly therefrom so as to contact the surface being worked upon when the cleaning tool is in its lowered operative position.

4. The structure of claim 3 further characterized by and including a sliding connection generally concentric about the axis of the tool between the tool drive and tool housing so that the squeegee on the tool housing and the some 180° squeegee exert pressure on the surface being worked upon independently of the cleaning tool when in the operative working position.

5. The structure of claim 4 in which the squeegees contact the surface being cleaned before the tool does when the tool is lowered to its operative working position and are raised out of contact with the surface being cleaned after the tool is raised therefrom when the tool is raised to its inoperative position for traveling.

6. The structure of claim 3 further characterized in that the single bladed squeegee extends around the full 360° periphery of the tool housing and serves as and defines one boundary of the arcuate vacuum chamber.

7. The structure of claim 1 further characterized by and including a sleeve on the tool drive and a bushing on the tool housing which surrounds the tool drive sleeve and rotates around it.

8. The structure of claim 4 further characterized by and including a stop arrangement on the sliding connection which will allow the tool, tool drive and motor to descend somewhat after the squeegees attached to the tool housing engage the surface being worked upon and will engage and pick up the tool housing and squeegees after the disk tool has been raised from the surface.

9. The structure of claim 1 in which the machine is constructed to be operated in separate buffing and scrubbing modes, the tool housing having a generally continuous depending peripheral skirt that engages the surface being cleaned when the cleaning tool is in its lowered operative position for working and extends around the full 360° periphery of the tool housing to define a dust control chamber during operation of the machine in its buffing mode, the arcuate vacuum chamber being bounded outwardly by a squeegee blade disposed around on the order of 180° of the periphery of the housing and defining in conjunction with part of the peripheral skirt the vacuum chamber for dirty solution when the machine is being operated in its scrubbing mode.

10. In a machine for removing soilage from a surface, a mobile frame and means for propelling it, a tool drive comprising a motor and a motor mount therefor attached to the frame, a disk surface cleaning tool connected to the tool drive disposed for rotation about a generally upright axis, means for raising and lowering the tool between a raised inoperative position for traveling and a lowered operative position for working, a housing around the tool to which is attached at least one squeegee disposed around on the order of 180° of the periphery of the circular housing which engages the surface in the working position of the tool and is raised above the surface in the raised traveling position of the tool, and a rotatable mounting for the tool housing concentric about the axis of the tool so that the tool housing may be rotated for at least a portion of a revolution about the upright axis independent of the tool and tool drive and the tool housing is free to circumferentially orient itself independently of movement of the mobile frame in response to movement of the mobile frame because of the force applied to it by friction from the engagement of the squeegee with the surface being worked upon.

* * * * *